US009857030B2

(12) United States Patent
Kanno et al.

(10) Patent No.: US 9,857,030 B2
(45) Date of Patent: Jan. 2, 2018

(54) CRYOGENIC TANK WITH ANCHORED MEMBRANE

(71) Applicant: IHI Corporation, Tokyo (JP)

(72) Inventors: Ryuzo Kanno, Tokyo (JP); Michitaka Furikoma, Tokyo (JP); Eiji Kamiya, Tokyo (JP)

(73) Assignee: IHI CORPORATION, Tokyo (JP)

( * ) Notice: Subject to any disclaimer, the term of this patent is extended or adjusted under 35 U.S.C. 154(b) by 0 days.

(21) Appl. No.: 15/150,195

(22) Filed: May 9, 2016

(65) Prior Publication Data

US 2016/0252212 A1 Sep. 1, 2016

Related U.S. Application Data

(63) Continuation of application No. PCT/JP2014/078982, filed on Oct. 30, 2014.

(30) Foreign Application Priority Data

Nov. 15, 2013 (JP) ..... 2013-236944

(51) Int. Cl.
*F17C 13/00* (2006.01)
*F17C 3/02* (2006.01)

(52) U.S. Cl.
CPC ..... *F17C 13/001* (2013.01); *F17C 3/022* (2013.01); *F17C 13/004* (2013.01); *F17C 2201/0128* (2013.01); *F17C 2201/0157* (2013.01); *F17C 2201/052* (2013.01); *F17C 2201/054* (2013.01); *F17C 2203/012* (2013.01); *F17C 2203/03* (2013.01); *F17C 2203/0333* (2013.01); *F17C 2203/0604* (2013.01);

(Continued)

(58) Field of Classification Search
CPC ..... F17C 13/001; F17C 2203/0604; F17C 2203/0678; F17C 2203/0333; F17C 2203/03; F17C 2209/23
See application file for complete search history.

(56) References Cited

U.S. PATENT DOCUMENTS 4,078,697 A * 3/1978 Schlosberg ..... B01J 19/0073 220/200
4,128,069 A 12/1978 Kotcharian

FOREIGN PATENT DOCUMENTS

JP 52-10722 B2 3/1977
JP 53-36758 A 4/1978
(Continued)

OTHER PUBLICATIONS

International Search Report dated Feb. 3, 2015 in PCT/JP2014/078982 (4 pages).

*Primary Examiner* — Stephen Castellano
(74) *Attorney, Agent, or Firm* — Rothwell, Figg, Ernst & Manbeck, P.C.

(57) ABSTRACT

A cryogenic tank includes a membrane anchor mechanism which fixes a membrane provided on an inner wall surface side of a concrete wall via a heat insulating material to the concrete wall, a pressing par which is provided by the membrane anchor mechanism and presses the membrane from the inside of the cryogenic tank, and an interposition part which is interposed between the pressing part of the membrane anchor mechanism and the membrane, and includes a first abutment surface coming into surface-contact with the pressing part and a second abutment surface coming into surface-contact with the membrane.

2 Claims, 5 Drawing Sheets

(52) U.S. Cl.
CPC .. *F17C 2203/0631* (2013.01); *F17C 2209/23* (2013.01); *F17C 2223/0161* (2013.01); *F17C 2223/033* (2013.01); *F17C 2260/011* (2013.01); *F17C 2270/0136* (2013.01)

(56) References Cited

FOREIGN PATENT DOCUMENTS

| | | | |
|---|---|---|---|
| JP | 60-118100 | U | 8/1985 |
| JP | 61-182406 | U | 11/1986 |
| JP | 62-117397 | U | 7/1987 |
| JP | 63-23440 | B2 | 5/1988 |
| JP | 3016632 | U | 10/1995 |
| JP | 8-247130 | A | 9/1996 |
| JP | 11-180494 | A | 7/1999 |
| JP | 2009-79736 | A | 4/2009 |

* cited by examiner

CRYOGENIC TANK WITH ANCHORED MEMBRANE

This application is a continuation application based on a PCT Patent Application No. PCT/JP2014/078982, filed on Oct. 30, 2014, whose priority is claimed on Japanese Patent Application No. 2013-236944, filed on Nov. 15, 2013. The contents of both the PCT Application and the Japanese Application are incorporated herein by reference.

TECHNICAL FIELD

The present embodiments described herein relate to a cryogenic tank.

BACKGROUND

In the related art, in a membrane type cryogenic tank including a membrane in which a plurality of membrane panels are welded, in order to maintain a shape of a thin membrane having low stiffness, a configuration which is supported to be pressed to a concrete wall via a heat insulating material by a membrane anchor mechanism is used (for example, refer to Japanese Examined Patent Application, Second Publication No. S63-23440). As the membrane type cryogenic tank, tanks having various shapes are used, and for example, a tank which is formed to have a square corner portion, a cylindrical corner portion, or the like is also used widely. In Japanese Unexamined Patent Application, First Publication No. 2009-79736, a membrane anchor mechanism which supports a membrane panel (corner membrane panel) installed in a corner portion of a cryogenic tank is disclosed. The membrane anchor mechanism disclosed in Japanese Unexamined Patent Application, First Publication No. 2009-79736 is installed at a boundary portion of a haunch structural portion provided on a corner portion, and supports an edge portion of the corner membrane panel.

SUMMARY

However, the above-described haunch structure is not necessarily provided on all cryogenic tanks having the corner portion. Accordingly, the membrane anchor mechanism disclosed in Japanese Unexamined Patent Application, First Publication No. 2009-79736 cannot be adopted with respect to all cryogenic tanks. Moreover, in the membrane anchor mechanism in which the support location is limited to the edge of the corner membrane panel, for example, disposition in which a center of the membrane panel is pressed cannot be performed.

Therefore, a configuration which includes a pressing part by which the membrane anchor mechanism presses the membrane from the inside of the cryogenic tank and presses an arbitrary position of the membrane is considered. However, when a surface of the membrane on which the pressing part is installed is not flat, the pressing part and the membrane do not come into surface-contact with each other, and sealing between the pressing part and the membrane is likely to be decreased.

The present disclosure is made in consideration of the above-described problems, and an object thereof is to prevent sealing between the pressing part and the membrane from being decreased when the membrane anchor mechanism includes the pressing part which presses the membrane from the inside of the cryogenic tank.

The present disclosure adopts the following configurations as means for solving the above-described problems.

According to a first aspect of the present disclosure, there is provided a cryogenic tank, including: a membrane anchor mechanism which fixes a membrane provided on an inner wall surface side of a concrete wall via a heat insulating material to the concrete wall; a pressing part which is provided by the membrane anchor mechanism and presses the membrane from the inside of the cryogenic tank; and an interposition part which is interposed between the pressing part of the membrane anchor mechanism and the membrane, and includes a first abutment surface coming into surface-contact with the pressing part and a second abutment surface coming into surface-contact with the membrane.

According to the present disclosure, the interposition part which is interposed between the pressing part of the membrane anchor mechanism and the membrane is provided, and the interposition part includes the first abutment surface coming into surface-contact with the pressing part and the second abutment surface coming into surface-contact with the membrane. Accordingly, even when the membrane has any shape, the interposition part abuts the pressing part and the membrane to come into surface-contact with both. Therefore, it is possible to prevent a decrease in sealing between the pressing part and the membrane.

DETAILED DESCRIPTION OF THE DISCLOSURE

Hereinafter, an embodiment of a cryogenic tank according to the present disclosure will be described with reference to the drawings. Moreover, in the following drawings, in order to allow each member to be a recognizable size, the scale of each member is appropriately changed.

Figure 1:
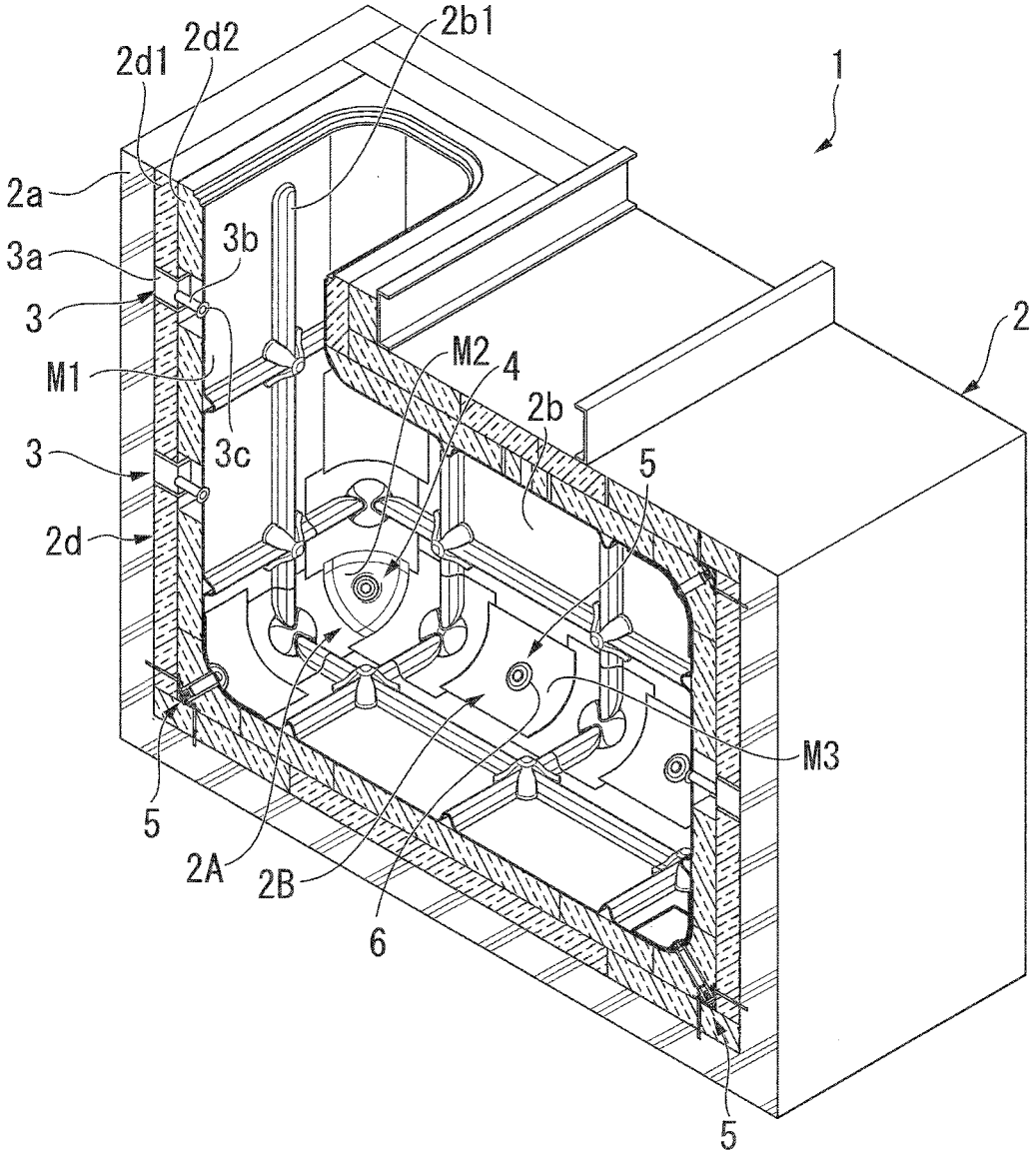
FIG. 1 is a cross-sectional perspective view showing a cryogenic tank according to an embodiment of the present disclosure.

FIG. 1 is a cross-sectional perspective view showing a cryogenic tank 1 of the present embodiment. The cryogenic tank 1 of the present embodiment includes a container main body 2, a plane membrane anchor mechanism 3, a three-surface corner membrane anchor mechanism 4, a two-surface corner membrane anchor mechanism 5, and a spacer 6 (interposition part).

The container main body 2 is a rectangular container which includes a concrete wall 2*a* forming an outer tank, a membrane 2*b* forming an inner tank, a vapor barrier 2*c* (refer to FIG. 2) stuck to an inner wall surface of the concrete wall 2*a*, and a cold insulating material layer 2*d* installed between the vapor barrier 2*c* and the membrane 2*b*.

The concrete wall 2*a* is a wall portion formed of concrete which forms an outer shell of the container main body 2 and a strength member which supports the membrane 2*b* or the like. The membrane 2*b* is a portion which directly comes into contact with a cryogenic liquid (for example, liquefied argon) stored in an inner portion of the tank, and is installed on the inner wall surface side of the concrete wall 2*a* via the cold insulating material layer 2*d*. A corrugation 2*b*1 which vertically and horizontally extends in a lattice shape and absorbs thermal deformation of the membrane 2*b* is provided on the membrane 2*b*. For example, the membrane 2*b* is formed by welding a sheet shaped membrane panel which is formed of stainless steel and has a thickness of several millimeters.

Since the container main body 2 is formed in a rectangular shape, the container main body 2 includes a corner portion (hereinafter, referred to as a three-surface corner portion 2A) formed at a location at which three surfaces (for example, two side wall surfaces and a bottom surface, or two side wall surfaces and a top surface) are collected, and a corner portion (hereinafter, referred to as a two-surface corner portion 2B) formed at a location at which two surfaces (for example, the side wall surface and the bottom surface, the side wall surfaces, or the side wall surface and the top surface) are collected. The membrane panel which is disposed on the corner portions is curved according to the shapes of the corner portions. Hereinafter, the membrane panel on a plane which is disposed on a region other than the corner portions is referred to as a plane membrane panel M1, the membrane panel which is disposed on the three-surface corner portion 2A is referred to as a three-surface corner membrane panel M2 (corner membrane panel), and the membrane panel which is disposed on the two-surface corner portion 2B is referred to as a two-surface corner membrane panel M3.

The vapor barrier 2*c* is a metal sheet member which is stuck to the entire region of the inner wall surface of the concrete wall 2*a*. The vapor barrier 2*c* blocks water or the like passing through the concrete wall 2*a* and improve airtightness of the container main body 2.

Figure 2:
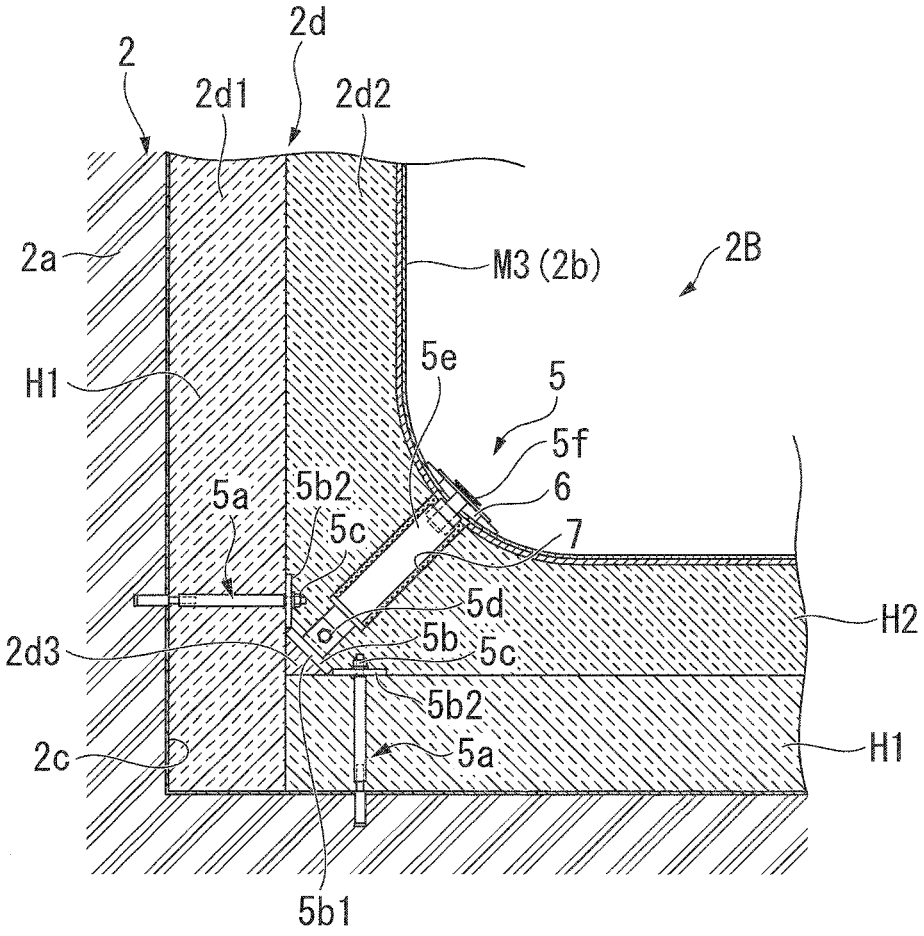
FIG. 2 is a cross-sectional view showing a two-surface corner portion including a two-surface corner membrane anchor mechanism which is included in the cryogenic tank according to the embodiment of the present disclosure.

The cold insulating material layer 2*d* includes an outer layer portion 2*d*1, an inner layer portion 2*d*2, and a filling portion 2*d*3 (refer to FIG. 2). The outer layer portion 2*d*1 is a layer which forms the concrete wall 2*a* side of the cold insulating material layer 2*d*, and is formed by laying cold insulating panels H1 having the same thickness without a gap. The inner layer portion 2*d*2 is a layer which forms the membrane 2*b* side of the cold insulating material layer 2*d*, and is formed by laying cold insulating panels H2 having the same thickness without a gap. The filling portion 2*d*3 is a portion which is filled with respect to a gap generated when the outer layer portion 2*d*1 and the inner layer portion 2*d*2 are laid, and has a shape coincident with the shape of the installed gap. For example, the filling portion 2*d*3 is filled in a gap which is formed between a base portion 5*b* and an outer layer portion 2*d*1 of the two-surface corner membrane anchor mechanism 5 described below.

For example, the cold insulating material layer 2*d* is formed of Poly Urethane Foam (PUF), and the gap between the membrane 2*b* and the concrete wall 2*a* to which the vapor barrier 2*c* is stuck is filled with the cold insulating layer.

A through-hole 7 which is disposed at a center position in the thermal deformation part of each membrane panel is provided on the membrane 2*b* and the cold insulating material layer 2*d*. An anchor 3*b* of the plane membrane anchor mechanism 3, an anchor of the three-surface corner membrane anchor mechanism 4, or an anchor 5*e* of the two-surface corner membrane anchor mechanism 5 is inserted into the through-hole 7.

The plane membrane anchor mechanism 3 includes a base 3*a* which is provided on the inner wall surface of the concrete wall 2*a* via the vapor barrier 2*c*, the anchor 3*b* which is fixed to the base 3*a* and is inserted into the through-hole 7, and a pressing part 3*c* which is fixed to the anchor 3*b* exposed from the through-hole 7 and presses the plane membrane panel M1 from the inner portion side of the container main body 2 toward the concrete wall 2*a*.

The three-surface corner membrane anchor mechanism 4 includes a leg portion which is provided on the three-surface corner portion 2A and is provided on each of the three surfaces forming the three-surface corner portion 2A, an anchor which is fixed to the leg portion and is inserted into the through-hole 7, and a pressing part which is fixed to the anchor exposed from the through-hole 7 and presses the three-surface corner membrane panel M2 from the inner portion side of the container main body 2 toward the concrete wall 2*a*.

Figure 3A:
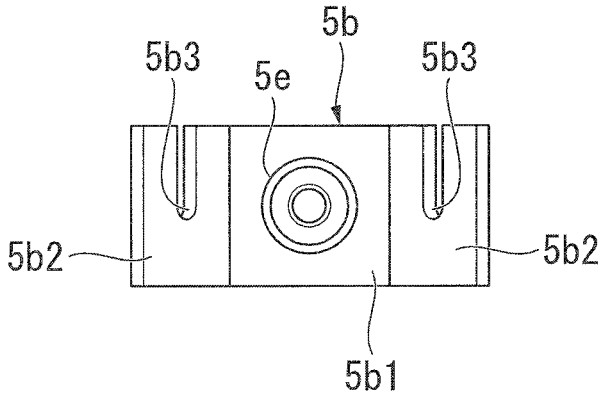
FIG. 3A is a plan view which shows the two-surface corner membrane anchor mechanism except for a leg portion and a pressing part included in the cryogenic tank according to the embodiment of the present disclosure when viewed in a direction along an axis of an anchor.
Figure 3B:
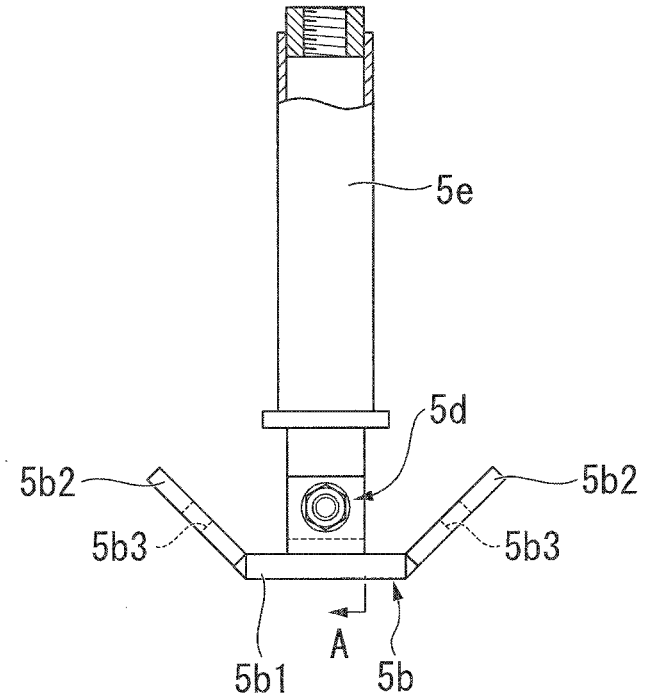
FIG. 3B is a side view when the two-surface corner membrane anchor mechanism shown in FIG. 3A is viewed in a direction orthogonal to the direction along the axis of the anchor.
Figure 3C:
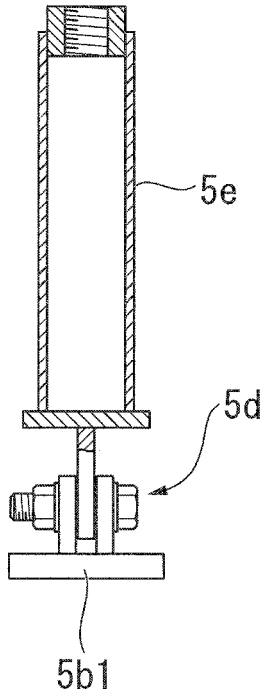
FIG. 3C is a view when the two-surface corner membrane anchor mechanism shown in FIG. 3B is viewed from arrow A.

FIG. 2 is a cross-sectional view showing the two-surface corner portion 2B including the two-surface corner membrane anchor mechanism 5. In addition, FIGS. 3A to 3C are views showing the two-surface corner membrane anchor mechanism 5 except for the leg portion 5*a* and the pressing part 5*f*, of which FIG. 3A is a plan view when the two-surface corner membrane anchor mechanism 5 is viewed in a direction along an axis of the anchor 5*e*, FIG. 3B is a side view when the two-surface corner membrane anchor mechanism 5 is viewed in a direction orthogonal to the direction along the axis of the anchor 5*e*, and FIG. 3C is a view when the two-surface corner membrane anchor mechanism 5 is viewed from arrow A of FIG. 3B.

As shown in the drawings, the two-surface corner membrane anchor mechanism 5 includes a leg portion 5*a* which is provided on the two-surface corner portion 2B and is provided on each of the two surfaces forming the two-surface corner portion 2B, a base portion 5*b*, a nut 5*c*, a joint 5*d*, the anchor 5*e*, and the pressing part 5*f*.

The leg portion 5*a* is a rod-shaped member which extends in the direction perpendicular to the inner wall surface of the concrete wall 2*a*, and is erected to the concrete wall 2*a* via the vapor barrier 2*c*. The leg portion 5*a* includes a first stud bolt which is formed on one end portion of the concrete wall 2*a* side, a second stud bolt which is formed on one end portion of the base portion 5*b* side, and a long nut which forms a center portion of the leg portion. A length of the leg portion 5*a* except for the second stud bolt is approximately the same as the thickness in the outer layer portion 2*d*1 of the cold insulating material layer 2*d*.

The base portion 5*b* is a portion to which two leg portions 5*a* or the anchor 5*e* is attached, and is provided at a position at which the second stud bolts of two leg portions 5*a* approach each other. The base portion 5*b* includes a center plate 5*b*1 on which the anchor 5*e* is installed via the joint 5*d*, and two leg portion connection plates 5*b*2 which are provided on edge portions of the center plate 5*b*1 and to which the leg portions 5*a* are connected. Each leg portion connection plate 5*b*2 is attached to the center plate 5*b*1 at an angle formed to oppose each surface of the concrete wall 2*a* forming the two-surface corner portion 2B. The leg portion connection plate 5*b*2 is disposed at a position at which the outer layer portion 2*d*1 abuts the surface of the inner layer portion 2*d*2 side in the above-described cold insulating material layer 2*d*. Moreover, a notch portion 5*b*3 is provided on the leg portion connection plate 5*b*2. The second stud bolt of the leg portion 5*a* passes through the notch portion 5*b*3 and protrudes to the side on which the anchor 5*e* is installed.

The notch portion 5*b*3 has a shape, in which one end in the longitudinal direction is opened, with the extension direction of the two-surface corner portion 2B as the longitudinal direction. As shown in FIG. 3, the notch portions 5*b*3 provided on two leg portion connection plates 5*b*2 are opened in the same direction. According to the notch portion 5*b*3, it is possible to adjust the position of the anchor 5*e* attached to the base portion 5*b* in the extension direction of the notch portion 5*b*3 (that is, the extension direction of the two-surface corner portion 2B).

The nut 5*c* is screwed to the second stud bolt which protrudes from the notch portion 5*b*3 of the leg portion connection plate 5*b*2 to the anchor 5*e* side, and abuts the surface of the anchor 5*e* side in the leg portion connection plate 5*b*2 via a washer. The nuts 5*c* screwed to the second stud bolts of the leg portions 5*a* press the base portion 5*b* in different directions, and thus, the base portion 5*b* is fixed.

The joint 5*d* is attached to the center plate 5*b*1 of the base portion 5*b* and rotatably supports the anchor Se. The joint 5*d* is configured to include a bolt which extends in a horizontal direction orthogonal to the extension direction of the anchor 5*e* as an axial direction thereof, and a nut which is screwed to the bolt and rotatably interposes the anchor Se along with the bolt. Since the anchor 5*e* is supported by the joint 5*d*, the anchor 5*e* can rotate about the horizontal direction orthogonal to the extension direction of the anchor Se.

The anchor 5*e* is a cylindrical member which is long in an axial direction thereof, and screw grooves for attaching the pressing part 5*f* are formed on the inner wall surface of the tip portion of the anchor. In the anchor Se, the base portion of the anchor is attached to the center plate 5*b*1 of the base portion 5*b* via the joint 5*d*, and the tip of the anchor to which the pressing part 5*f* is fixed is inserted into the through-hole 7 to be exposed toward the inside of the container main body 2. The length of the anchor Se is approximately the same as the thickness of the inner layer portion 2*d*2 of the cold insulating material layer 2*d*. The anchor Se is supported by the base portion 5*b*, and thus, the anchor is supported in the state of being separated from the concrete wall 2*a*.

Figure 4A:
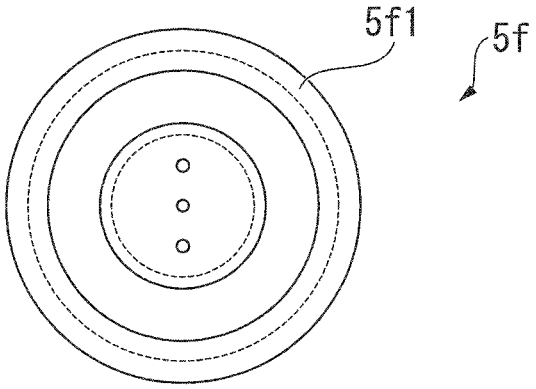
FIG. 4A is a plan view showing the pressing part included in the cryogenic tank according to the embodiment of the present disclosure.
Figure 4B:
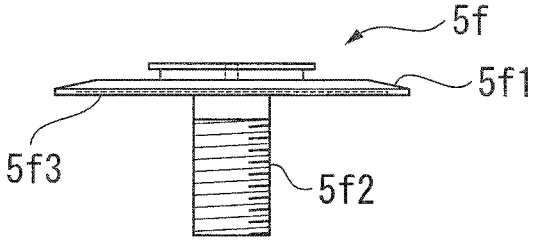
FIG. 4B is a side view showing the pressing part shown in FIG. 4A.

FIGS. 4A and 4B are views showing the pressing part 5*f*, of which FIG. 4A is a plan view of the pressing part, and FIG. 4B is a side view of the pressing part. As shown in these drawings, the pressing part 5*f* includes a disk-shaped main body 5*f*1 and a shaft portion 5*f*2 which is integrated with the main body 5*f*1. In the main body 5*f*1, the surface (hereinafter, referred to as an abutment surface 5*f*3) of the main body to which the shaft portion 5*f*2 is attached is formed in a plane. The shaft portion 5*f*2 is provided on the center portion of the main body 5*f*1 of the abutment surface 5*f*3 side, and is a columnar portion in which screw grooves are formed on the circumferential surface thereof. The shaft portion 5*f*2 is screwed to the anchor 5*e*. The shaft portion 5*f*2 is screwed to the anchor 5*e* to fasten the pressing part 5*f*, and thus, the main body 5*f*1 presses the two-surface corner membrane panel M3 toward the concrete wall 2*a* via the spacer 6, and the two-surface corner membrane panel M3 is fixed to the concrete wall 2*a*. In addition, the edge of the main body 5*f*1 of the pressing part 5*f* is fixed to the spacer 6 by welding.

Figure 5A:
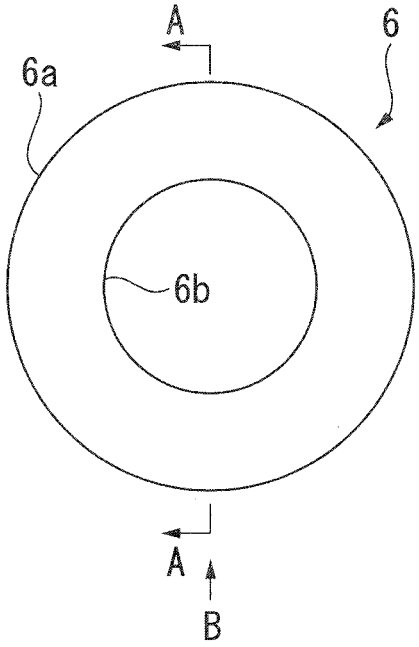
FIG. 5A is a plan view showing a spacer included in the cryogenic tank according to the embodiment of the present disclosure.
Figure 5B:
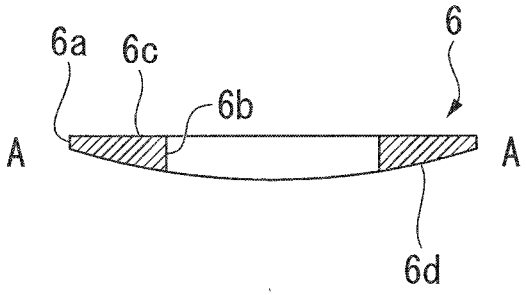
FIG. 5B is a cross-section view taken along line A-A of the spacer shown in FIG. 5A.
Figure 5C:
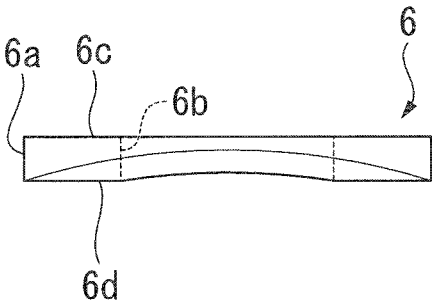
FIG. 5C is a view when the spacer shown in FIG. 5A is viewed from arrow B.

FIGS. 5A to 5C are views showing the spacer 6, of which FIG. 5A is a plan view of the spacer, FIG. 5B is a cross-sectional view taken along line A-A of FIG. 5A, and FIG. 5C is a view when viewed from arrow B of FIG. 5A. An outer edge 6*a* of the spacer 6 is a circular shape, and the spacer is an approximately disk-shaped member having a circular opening 6*b* at the center portion of the spacer. Moreover, the spacer 6 is interposed between the pressing part 5*f* of the two-surface corner membrane anchor mechanism 5 and the two-surface corner membrane panel M3, and includes a pressing part abutment surface 6*c* (first abutment surface) which comes into surface-contact with the pressing part 5*f*, and a membrane abutment surface 6*d* (second abutment surface) which comes into surface-contact with the two-surface corner membrane panel M3.

The spacer 6 is disposed to surround the connection location between the anchor Se exposed from the through-hole 7 and the pressing part 5*f* screwed to the tip of the anchor Se. The pressing part abutment surface 6*c* is a region which comes into surface-contact with the abutment surface 5*f*3 of the pressing part 5*f*, and is formed in a plane to come into surface-contact with the abutment surface 5*f*3 of the pressing part 5*f*.

The membrane abutment surface 6*d* is a region which comes into surface-contact with the two-surface corner membrane panel M3, and is curved to match the surface of the two-surface corner membrane panel M3 to come into surface-contact with the two-surface corner membrane panel M3.

As described above, the spacer 6 is interposed between the pressing part 5*f* of the two-surface corner membrane anchor mechanism 5 and the two-surface corner membrane panel M3, and the outer edge 6*a* is welded to the two-surface corner membrane panel M3 and thus, is fixed to the membrane panel. Moreover, the outer edge of the pressing part 5*f* is welded to the pressing part abutment surface 6*c*.

According to the above-described cryogenic tank 1 of the present embodiment, the spacer 6 which is interposed between the pressing part 5*f* of the two-surface corner membrane anchor mechanism 5 and the two-surface corner membrane panel M3 is provided, and the spacer 6 includes the pressing part abutment surface 6*c* which comes into surface-contact with the pressing part 5*f* and the membrane abutment surface 6*d* which comes into surface-contact with the two-surface corner membrane panel M3. Accordingly, even when the membrane panel such as the two-surface corner membrane panel M3 has a curved shape, the spacer 6 abuts the pressing part 5*f* and the two-surface corner membrane panel M3 to come into surface-contact with both, and thus, it is possible to prevent a decrease of sealing between the pressing part 5*f* and the two-surface corner membrane panel M3.

Moreover, in the cryogenic tank 1 of the present embodiment, since the spacer 6 is interposed between the two-surface corner membrane panel M3 and the abutment surface 5*f*3 having the surface shapes different form each other in which the surface-contact is not easily performed, it is possible to use an advantage of the installation of the spacer 6 to the maximum.

In addition, in the cryogenic tank 1 of the present embodiment, the shape of the spacer 6 is set to an annular shape which is disposed to surround the connection location between the anchor 5*e* and the pressing part 5*f* of the two-surface corner membrane anchor mechanism 5. Before the pressing part 5*f* is screwed to the anchor 5*e*, the spacer 6 is disposed to surround the anchor 5*e* when viewed in the axial direction of the anchor 5*e*, and thereafter, the pressing part 5*f* is attached to the anchor 5*e*, and thus, it is possible to easily interpose the spacer 6 between the pressing part 5*f* and the two-surface corner membrane panel M3.

While preferred embodiments of the disclosure have been described and illustrated above, it should be understood that these are exemplary of the disclosure and are not to be considered as limiting. Additions, omissions, substitutions, and other modifications can be made without departing from the spirit or scope of the present disclosure. Accordingly, the disclosure is not to be considered as being limited by the foregoing description, and is only limited by the scope of the appended claims.

For example, in the above-described embodiment, the configuration in which the spacer 6 is interposed between the pressing part 5*f* of the two-surface corner membrane anchor mechanism 5 and the two-surface corner membrane panel M3 is described.

However, the present disclosure is not limited to this, and it is possible to adopt a configuration which includes a spacer which is interposed between the plane membrane panel M1 and the pressing part 3*c* of the plane membrane anchor mechanism 3, or between the three-surface corner membrane panel M2 and the pressing part of the three-surface corner membrane anchor mechanism 4.

In addition, in the above-described embodiment, it is possible to adjust the position of the two-surface corner membrane anchor mechanism 5 in the extension direction of the two-surface corner portion 2B. Accordingly, for example, a configuration may be adopted in which the outer shape (the shape of the outer edge 6*a*) of the spacer 6 and the shape of the opening 6*b* are formed in elliptical shapes which are long in a direction (that is, in the extension direction of the two-surface corner portion 2B) in which the position of the anchor 5*e* can be adjusted. If this configuration is adopted, since the opening 6*a* is formed in an elliptical shape, it is possible to adjust the position of the two-surface corner membrane anchor mechanism 5 without changing the installation position of the spacer 6. In addition, similarly, since the outer shape of the spacer 6 is also formed in an elliptical shape, even when the positional relationship between the spacer 6 and the pressing part 5*f* is changed by adjusting the position of the two-surface corner membrane anchor mechanism 5, it is possible to sufficiently and widely secure the contact area between the spacer 6 and the pressing part 5*f*, and high sealing can be secured.

According to the present disclosure, when the membrane anchor mechanism includes the pressing part which presses the membrane from the inside of the cryogenic tank, a decrease in sealing between the pressing part and the membrane is prevented.

What is claimed is:

1. A cryogenic tank, comprising:

a membrane anchor mechanism which fixes a membrane provided on an inner wall surface side of a concrete wall via a heat insulating material to the concrete wall;

a pressing part which is provided by the membrane anchor mechanism and presses the membrane from the inside of the cryogenic tank; and an interposition part which is interposed between the pressing part of the membrane anchor mechanism and the membrane, and includes a first abutment surface coming into surface-contact with the pressing part and a second abutment surface coming into surface-contact with the membrane;

wherein the membrane includes a corner membrane panel which is a curved membrane panel disposed at a corner portion of the tank, with the corner portion of the tank formed by two surfaces, and the interposition part is interposed between the pressing part and the membrane at the corner membrane panel, and the second abutment surface is curved and is in surface-contact with the corner membrane panel, wherein an outer edge of the interposition part is welded to the membrane to fix the interposition part to the membrane, and an outer edge of the pressing part is welded to the first abutment surface to fix the outer edge of the pressing part to the first abutment surface.

2. The cryogenic tank according to claim 1, wherein the membrane anchor mechanism includes an anchor which is inserted into a through-hole passing through the heat insulating material and the membrane and in which the pressing part is fixed to a tip exposed through the through-hole, and wherein a shape of the interposition part is set to an annular shape which is disposed to surround a connection location between the anchor and the pressing part.

* * * * *